US007318753B2

(12) United States Patent
Chung et al.

(10) Patent No.: US 7,318,753 B2
(45) Date of Patent: Jan. 15, 2008

(54) ELECTRICAL JACK WITH IMPROVED GROUNDING CONTACT

(75) Inventors: Yung-Chien Chung, Tu-Cheng (TW); Kun-Hua Chen, Tu-Cheng (TW); Wei-Nan Kuo, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/484,432

(22) Filed: Jul. 11, 2006

(65) Prior Publication Data

US 2007/0010106 A1 Jan. 11, 2007

(30) Foreign Application Priority Data

Jul. 11, 2005 (CN) ..... 2005 2 0073606

(51) Int. Cl.
*H01R 24/04* (2006.01)

(52) U.S. Cl. ..... 439/668; 439/607

(58) Field of Classification Search ..... 439/668, 439/669, 607, 63

See application file for complete search history.

(56) References Cited

U.S. PATENT DOCUMENTS 4,937,404 A * 6/1990 Kitagawa ..... 200/51.09
5,092,795 A * 3/1992 Kitagawa ..... 439/668
6,050,854 A * 4/2000 Fang et al. ..... 439/607
6,077,126 A * 6/2000 Peng ..... 439/668
6,093,058 A * 7/2000 Wu ..... 439/607
6,190,205 B1 * 2/2001 Wu ..... 439/607
6,592,408 B2 * 7/2003 Ma et al. ..... 439/669
2005/0124220 A1 * 6/2005 Wang ..... 439/607

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

An electrical jack (100) for mating with an audio plug includes an insulative housing (1) defining a longitudinal central hole (101), a plurality of channels, and a pair of gaps communicating with the central hole. A plurality of conductive contacts are received in the channels and each has a contact section, a retention section secured in the channels, and a solder section extending out of the insulative housing. A grounding contact (3) with a top plate (35) and a pair of side plates (31, 33) encloses the insulative housing. Each side plate has a spring arm (311, 331) extending through the gap into the central hole thereby increasing the mating force with the mating plug.

16 Claims, 6 Drawing Sheets

ELECTRICAL JACK WITH IMPROVED GROUNDING CONTACT

BACKGROUND OF THE INVENTION

1. Field of the Invention

The present invention generally relates to an electrical jack, and more particularly to an electrical jack for insertion of an audio plug.

2. Description of Related Art

Electrical jack for mating with an audio plug usually includes an insulative housing, a plurality of electrical contacts, and a grounding contact. The insulative housing defines a receiving space for receiving an audio plug and a plurality of channels for receiving the electrical and grounding contacts. The electrical contacts and grounding contact includes solder tails for mounting to a motherboard. When the audio plug inserts into the electrical jack, the electrical contacts and grounding contact are pushed outward to make electrical connection therebetween. When the plug is withdrawn, the contacts return to its original position. It is noted that above-mentioned performance requires that the contacts have excellent resiliency. However, this results in the contacts being difficult to provide sufficient contact force on the plug. In addition, it is conventional to mount a metallic shell to an electrical connector to get better shield. But in the application of mobile phone or other electrical consumer product, the electrical jack with shell occupies more room and complicates the structure thereof.

Hence, an improved electrical connector is desired to overcome the problems mentioned above.

BRIEF SUMMARY OF THE INVENTION

Accordingly, an object of the present invention is to provide an electrical jack wherein the electrical jack has improved grounding contact to increase mating force.

Another object of the present invention is to provide an electrical jack, which has preferable shielding effect and improved structure intensity with fewer elements.

In order to achieve the above-mentioned object, an electrical jack includes an insulative housing defining a longitudinal central hole, a plurality of channels, and a pair of gaps communicating with the central hole. A plurality of conductive contacts are received in the channels and each has a contact section, a retention section secured in the channels, and a solder section extending out of the insulative housing. A grounding contact has a top plate and a pair of side plates enclosed the insulative housing. Each side plate includes a spring arm extending through the gap into the central hole for contact with a mating audio plug.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
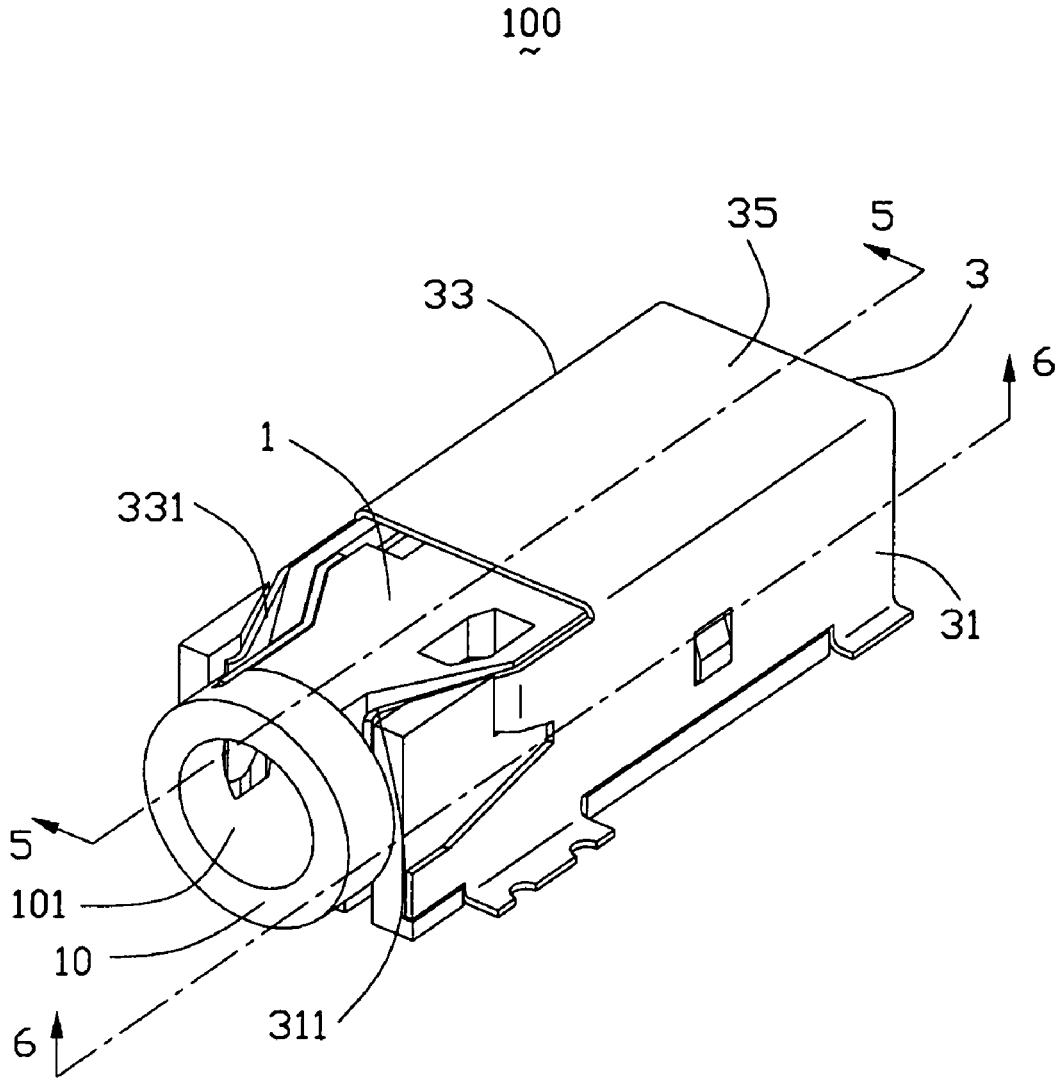
FIG. 1 is a perspective view of an electrical jack in accordance with the present invention.
Figure 2:
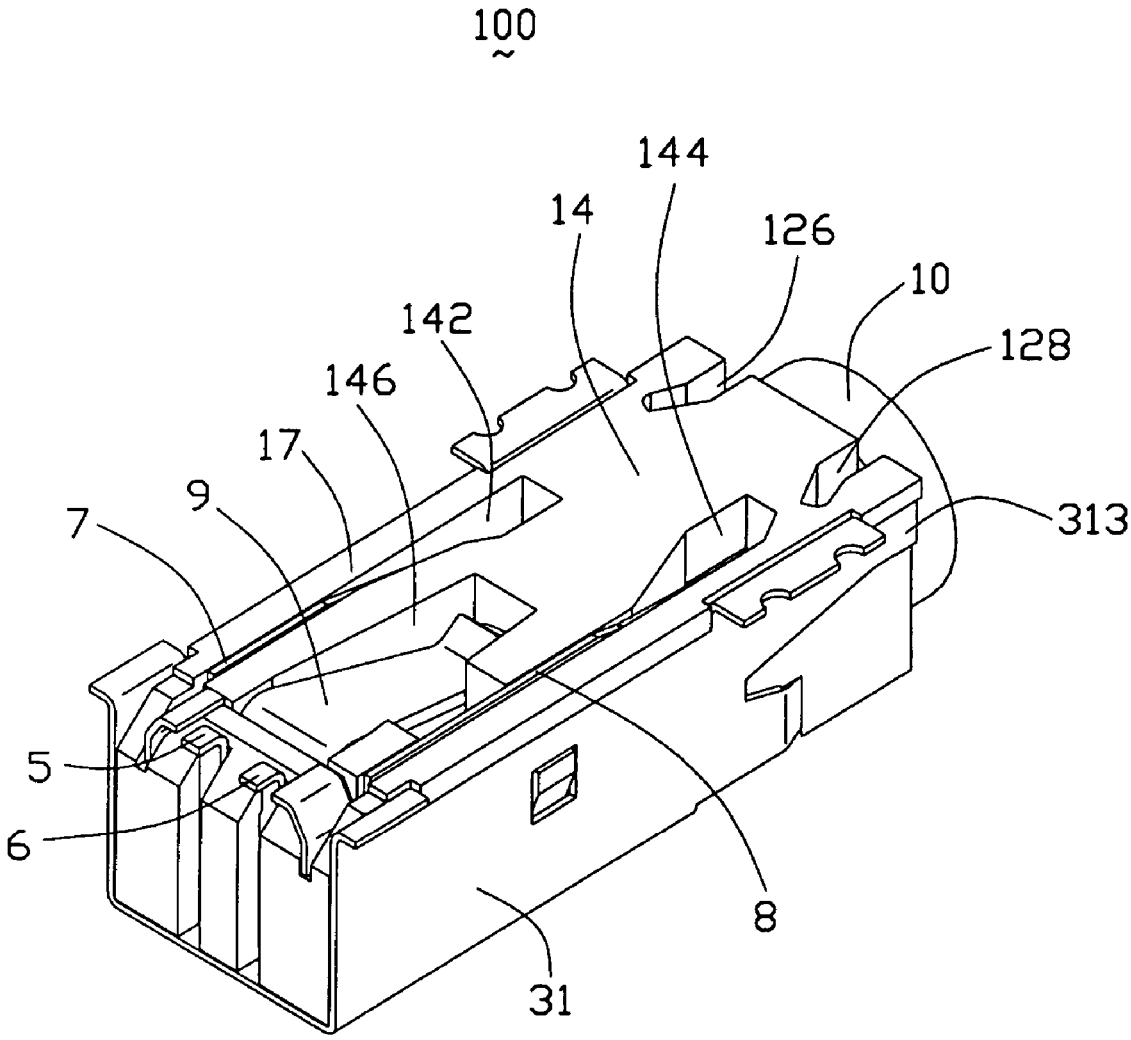
FIG. 2 is a view similar to FIG. 1, but viewed from a different angle.

Reference will now be made to the drawing figures to describe the present invention in detail.

Referring to FIGS. 1-6, an electrical jack 100 in accordance with the present invention, which is mounted to a printed circuit board and adapted for mating with an audio plug (not shown), comprises an insulative housing 1, a plurality of conductive contacts mounted to the insulative housing 1, a grounding contact 3, and a support contact 9.

Figure 3:
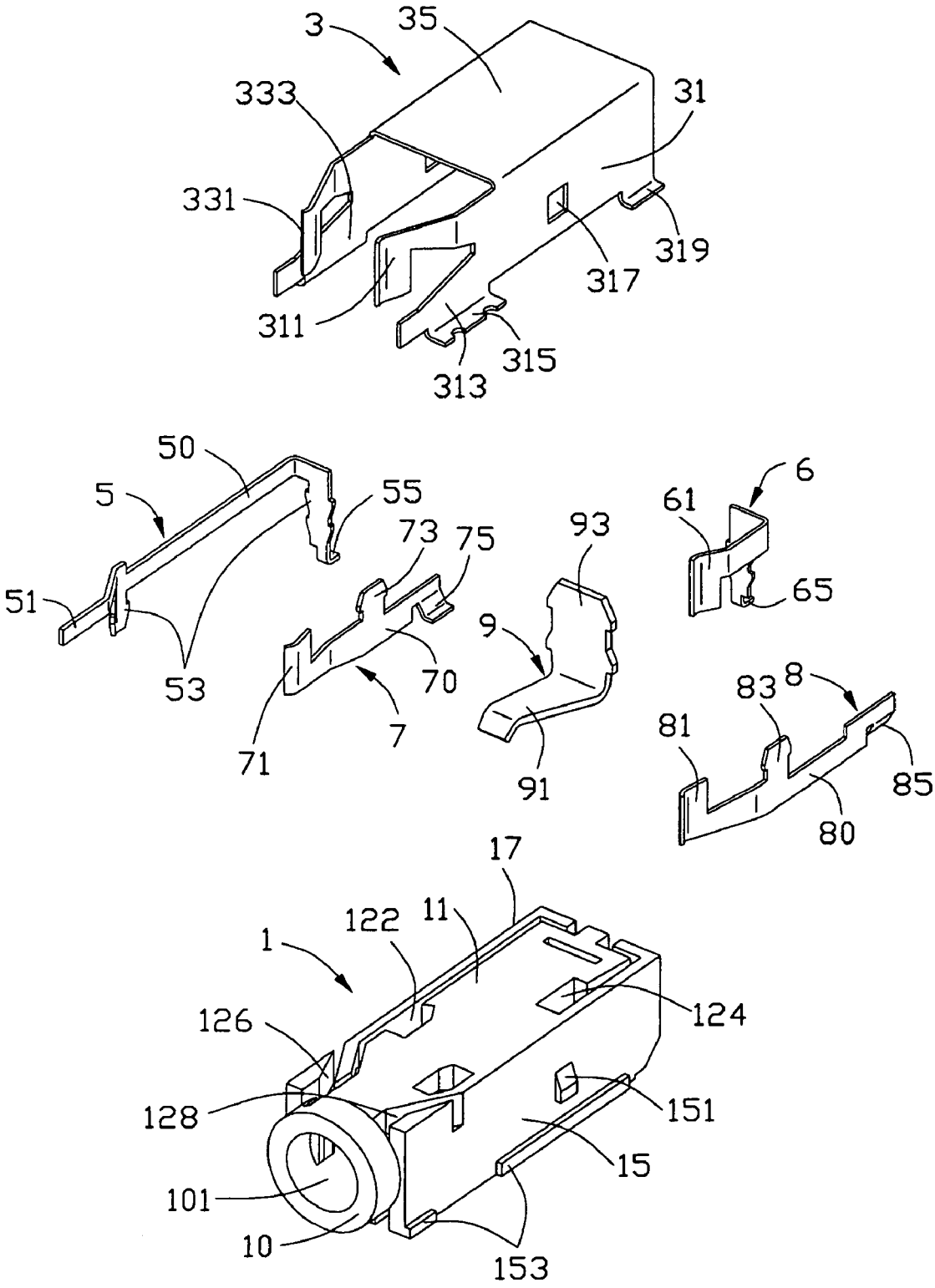
FIG. 3 is an exploded view of the electrical jack of the present invention.
Figure 4:
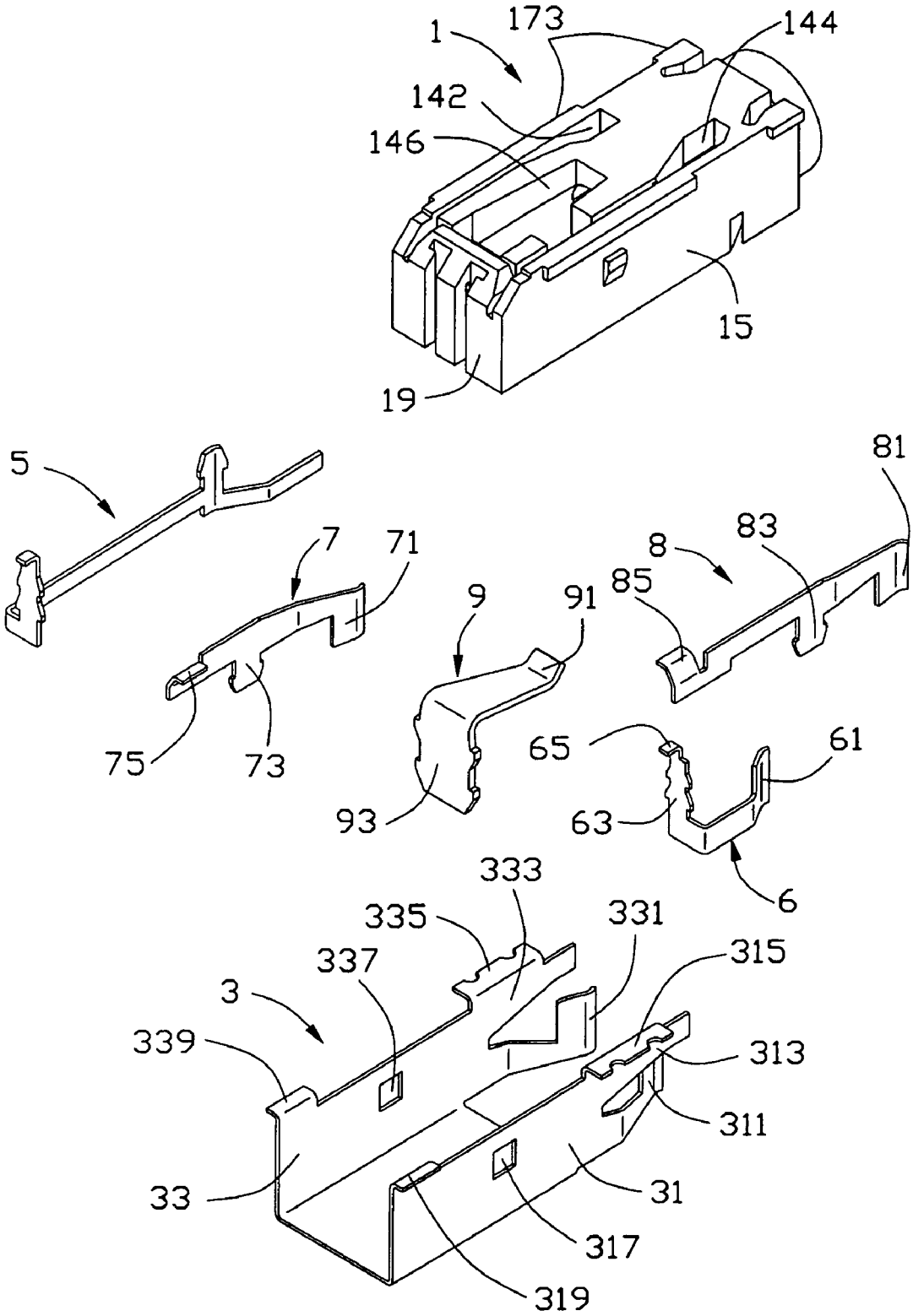
FIG. 4 is a view similar to FIG. 3, but viewed from a different angle.
Figure 5:
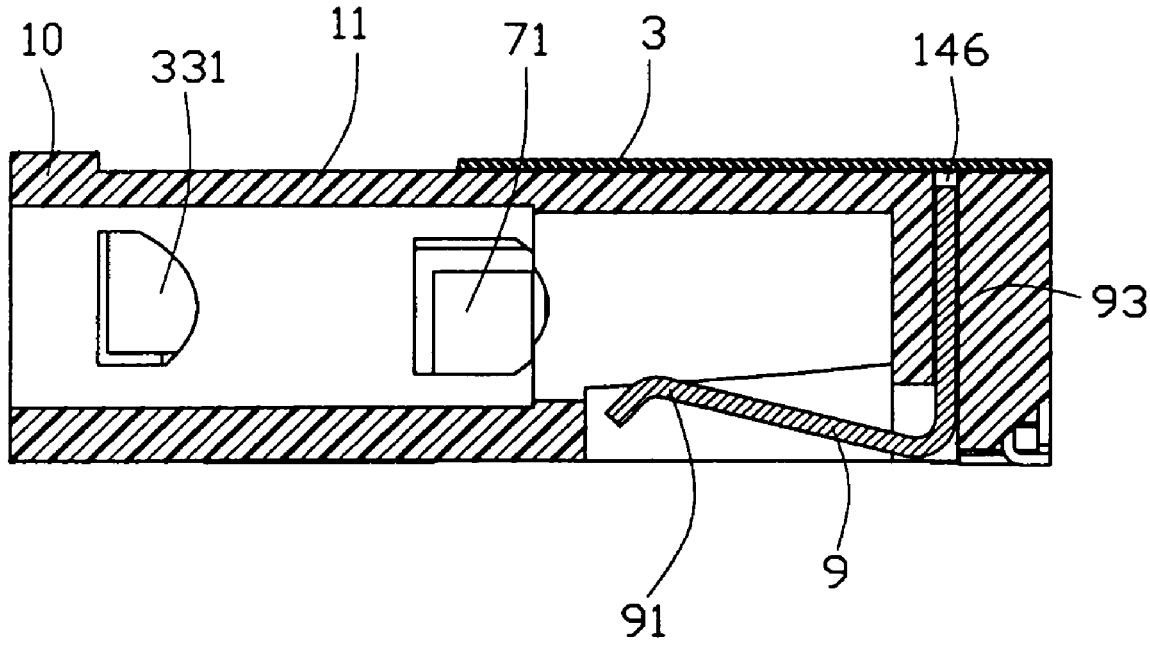
FIG. 5 is a cross-section view of the electrical jack taken along line 5-5 of FIG. 1.
Figure 6:
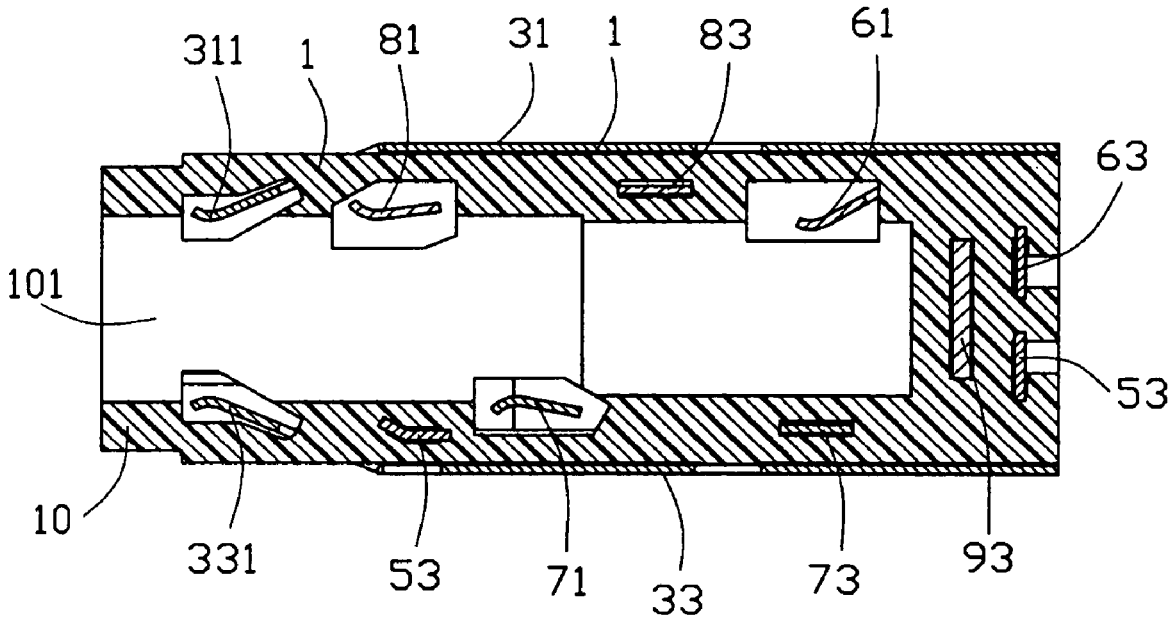
FIG. 6 is a cross-section view of the electrical jack taken along line 6-6 of FIG. 1.

Referring to FIGS. 3 and 4, the insulative housing 1 extends along an axis, the housing having a top wall 11, a bottom wall 14, a pair of sidewalls 15, 17 connecting with the top wall 11 and the bottom wall 14, and a rear wall 19 connected the pair of sidewalls 15, 17. The insulative housing 1 includes a cylindered project portion 10 at a front end and extending from a front face thereof. The insulative housing 1 defines a longitudinal central hole 101 extending from the project portion 10 to the rear wall 19 for received the mating audio plug. A block 151 is positioned on each sidewall 15, 17. A rib 153, 173 is defined on a bottom edge of each sidewall 15, 17.

Please also referring to FIGS. 3 and 4, the insulative housing 1 defines a longitudinal first channel 122 on the top wall 12 adjacent to the sidewall 17 and extends from the project portion 10 to the rear wall 19 thereof. A second channel 124 is defined on the top wall 12 and rear wall 19 adjacent to the sidewall 15 in a rear end of the insulative housing 1. The insulative housing 1 also defines a pair of gaps 126, 128 beside the central hole 101 on the sidewalls 15, 17 and the top wall 12 adjacent to the projection portion 10 thereof. The gap extends in two directions perpendicular to the housing. A third channel 142 and a fourth channel 144 are provided on the bottom wall 14 and the rear wall 19 on the opposite sides of the central hole 10. The bottom wall 14 also comprises an L-shaped opening 146 communicating with the central hole 10.

The conductive contacts include a first, a second, a third, and a fourth contact 5, 6, 7, 8. The first contact 5 includes a body section 50, a pair of retention sections 53 extending vertically from the body section 50, a contact section 51 extending from the body section 50 forwardly, and a solder section 55 extending from a rear retention section 53 thereof. The second contact 6 has a retention section 63, a contact section 61 extending from the retention section 63 forwardly, and a solder section 65 connected with the retention section 63. The third contact 7 comprises a body section 70, a retention section 73 extending vertically from the body section 70. A contact section 71 and a solder section 75 extend from opposite ends of the body portion 70. The fourth contact 8 is similar to the third contact 7 having a body section 80, a contact section 81, a retention section 83, and a solder section 85. A support contact 9 comprises a retention section 93 and a spring contact section 91 connected with the retention section 93. Each retention section 53, 63, 73 83, 93 provides at least one blade laterally stamped therefrom for interfering with the channels 122, 124, 142, 144 and the opening 146.

The grounding contact 3 comprises a top plate 35 and a pair of side plates 31, 33 extending downwardly from opposite edges of the top plate 35. Each side plate 31, 33 provides a spring arm 311, 331 at a front end thereof. The side plate 31, 33 also comprises a lower arm 313, 333 below the spring arm 311, 331. Each side plate 311, 331 defines a recess 317, 337 for receiving the block 151, 171. A pair of front solder tails 315, 335 and a pair of rear solder tails 319, 339 extend laterally and outwardly at opposite ends of the side plates 31, 33.

Also referring to FIGS. 3-6, in assembly, the first and second contact 5, 6 are respectively received in the first and second channel 122, 124 from the top wall 11 of the insulative housing 1. The third and fourth contact 7, 8 are respectively received in the third and fourth channel 142, 144 from the bottom wall 14. The contact sections 51, 61, 71, 81 of the first, second, third, fourth contact 5, 6, 7, 8 extend into the central hole 101. The support contact 9 is received in the opening 146 with spring contact section 91 extending into the central hole 101. The spring arms 311, 331 of the grounding contact 3 extend through the gaps 128, 126 into the central hole 101 from the top wall 11 of the insulative housing 1. The top plate 35 and the side plates 31, 33 of the grounding contact 3 extend to a rear face of the insulative housing 1. The lower arms 313, 333 of the side plates 31, 33 also extend to the front face of the insulative housing 1 so that the grounding contact 3 encloses the majority of the insulative housing 1 and increases the structure intensity of the electrical jack 100. The solder section 55, 65, 75, 85 of the conductive contacts 5, 6, 7, 8 and the solder tails 315, 335, 319, 339 of the grounding contact 3 extends out of the insulative housing 1 for electrically connected with the printed circuit board. The support contact 9 is received in the insulative housing 1 entirely without electrical and mechanical connection with the printed circuit board.

When the mating audio plug is mated with the electrical jack 100, the audio plug engages with the conductive contacts 5, 6, 7, 8 for building electrical connection therebetween. The grounding contact 3 also engages with the audio plug with the pair of spring arms 311, 331 connected therewith for providing ground path and ensuring the audio plug received in the electrical jack 100 reliably. The grounding contact 3 provides two spring arms 311, 331 connected with the audio plug and more than two solder tails mounted to the printed circuit board thereby reducing the impedance of the electrical jack 100.

It is to be understood, however, that even though numerous characteristics and advantages of the present invention have been set fourth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical jack for mating with an audio plug, comprising:

an insulating housing defining a longitudinal central hole, a plurality of channels, and a pair of gaps communicating with the central hole;

a plurality of conductive contacts received in the channels and each having a contact section, a retention section secured in the channels, and a solder section extending out of the insulative housing; and a grounding contact having a top plate, a pair of side plates enclosed the insulative housing, and a pair of front solder tails and a pair of rear solder tails at opposite ends thereof, each side plate having a spring arm extending through the gap into the central hole for contact with the audio plug.

2. The electrical jack as claimed in claim 1, wherein said insulative housing comprises a top wall, a bottom wall, and a pair of sidewalls, and each said gap is defined on one of the sidewall and the top wall.

3. The electrical jack as claimed in claim 1, wherein the insulative housing further comprises a project portion in a front end thereof.

4. The electrical jack as claimed in claim 1, wherein the top plate and the pair of side plates of the grounding contact extend to a rear face of the insulative housing.

5. The electrical jack as claimed in claim 1, wherein said conductive contact includes a first, a second, a third, and a fourth contact.

6. The electrical jack as claimed in claim 1, further comprising a support contact mounted to an opening defined on the bottom wall of the insulative housing, wherein said support contact has a contact section and a retention section received in the opening without electrical and mechanical connection with a printed circuit board on which the electrical jack mounted.

7. The electrical jack as claimed in claim 1, wherein each side plate comprises a lower arm below the spring arm extending to a front face of the insulative housing.

8. An electrical connector comprising:

an insulative housing defining a central hole extending along a front-to-back direction;

a gap formed in a thee of said housing and communicating with the central hole;

a metallic shield defining at least one wall covering at least one face of the housing;

a spring arm extending from the at least one wall and received in the gap and further extending into the central hole for coupling to an inserted plug; and a grounding contact having a top plate, a pair of side plates enclosed the insulative housing, and a pair of front solder tails and a pair of rear solder tails at opposite ends thereof.

9. The connector as claimed in claim 8, wherein said gap communicates with two faces of the housing which are perpendicular to each other, in said second and third directions, respectively.

10. The connector as claimed in claim 9, wherein said spring arm is hidden behind said at least one face.

11. The connector as claimed in claim 9, wherein said two faces includes said at least one face and another face.

12. The connector as claimed in claim 8, wherein another gap is formed in said another face and communicates said central hole with the exterior, and a contact is loaded from said another face and received in said another gap for coupling to the inserted plug.

13. The connector as claimed in claim 12, wherein said shield further includes another wall covering said another face.

14. The connector as claimed in claim 8, wherein said shield further includes another arm located adjacent to said spring arm and covering said at least one face so as to cooperate with said spring arm to sandwich a corresponding portion on the housing therebetween.

15. An electrical connector comprising:

an insulative housing defining a central hole extending along a first direction;

a gap formed in a face of said housing and communicating the central hole with an exterior in a second direction perpendicular to said first direction;

a metallic shield defining at least one wall covering at least one face of the housing; and a spring arm extending from the at least one wall and received in the gap and further extending into the central hole for coupling to an inserted plug; wherein said spring arm is deflectable in a third direction perpendicular to both said first direction and said second direction; wherein said gap extends, in said second and third directions, through two faces of the housing which are perpendicular to each other.

16. The connector as claimed in claim 15, wherein the spring arm extends essentially along the first direction while a contacting section of said spring arm, which is adapted to be coupled to the inserted plug, extends in the second direction.

* * * * *